United States Patent [19]

Mazur

[11] 4,261,154

[45] Apr. 14, 1981

[54] METHOD AND AN EXTERNAL PLATING ARRANGEMENT FOR SEALING OFF THE COLD END OF A REFRACTORY BRICK

[75] Inventor: Jeffrey A. Mazur, Pittsburgh, Pa.

[73] Assignee: General Refractories Company, Bala Cynwyd, Pa.

[21] Appl. No.: 28,887

[22] Filed: Apr. 10, 1979

[51] Int. Cl.[3] ..... E04B 5/04

[52] U.S. Cl. ..... 52/599; 110/340; 52/741

[58] Field of Search ..... 52/598, 599, 741; 110/340

[56] References Cited

U.S. PATENT DOCUMENTS

| | | | |
|---|---|---|---|
| 2,125,192 | 7/1938 | Morlock . | |
| 2,125,193 | 7/1938 | Morlock . | |
| 2,180,969 | 11/1939 | Seil . | |
| 2,216,813 | 10/1940 | Goldschmidt . | |
| 2,465,170 | 3/1949 | Rochow | 52/599 X |
| 2,764,887 | 10/1956 | D'Ambly . | |
| 2,791,116 | 5/1957 | Hewes et al. . | |
| 2,901,990 | 9/1959 | Hutter . | |
| 3,073,067 | 1/1963 | Shonkwiler | 110/340 |
| 3,301,546 | 1/1967 | Hansen et al. . | |
| 3,832,478 | 8/1974 | Books . | |

FOREIGN PATENT DOCUMENTS

| | | | |
|---|---|---|---|
| 639870 | 3/1964 | Belgium | 52/598 |
| 1347970 | 11/1963 | France | 52/598 |
| 885001 | 12/1961 | United Kingdom | 110/340 |

*Primary Examiner*—Price C. Faw, Jr.
*Assistant Examiner*—Carl D. Friedman
*Attorney, Agent, or Firm*—Everett H. Murray, Jr.; Brian G. Brunsvold; Thomas L. Irving

[57] ABSTRACT

An external plating arrangement for improved effectiveness in sealing off the cold end face of a refractory body, wherein the side walls of the body are sheathed with metal plates and planar portions extend normally from the plates and overlie the cold end face for encasing the perimeter of the cold end face. A separate metal plate may cover the cold end face, the planar portions having a form of elongated tabs for overlying the end plate. Alternatively, the planar portions may be right triangular for completely covering the cold end face, or one of the planar portions may be rectangular for covering the cold end face, the other planar portions being elongated tabs overlying the rectangular plate.

21 Claims, 9 Drawing Figures

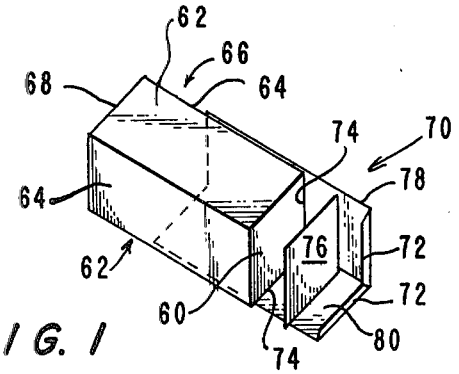
FIG. 1
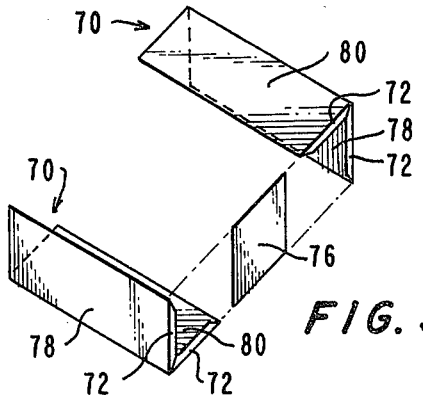
FIG. 3
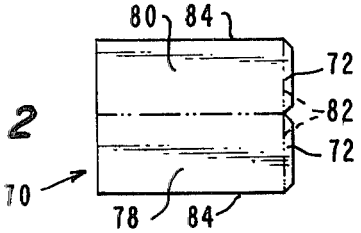
FIG. 2
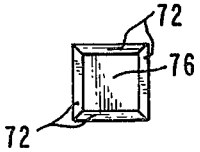
FIG. 4
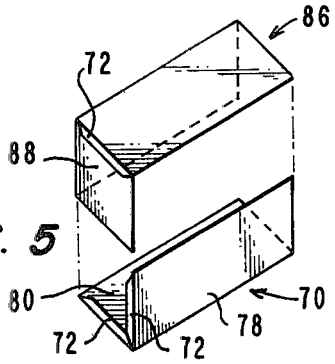
FIG. 5
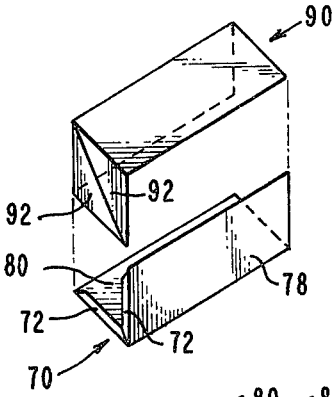
FIG. 7
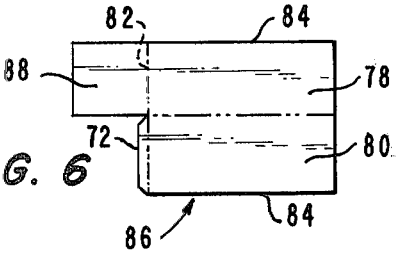
FIG. 6
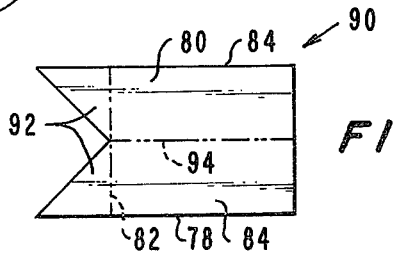
FIG. 8
FIG. 9
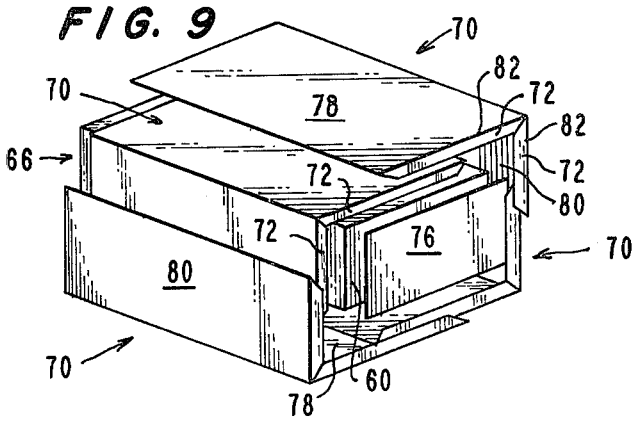

METHOD AND AN EXTERNAL PLATING ARRANGEMENT FOR SEALING OFF THE COLD END OF A REFRACTORY BRICK

BACKGROUND OF THE INVENTION

The present invention relates to a refractory structure having an external casing covering the cold end face of a refractory brick, the structure having particular use in lining furnaces. The invention also relates to a method for more effectively sealing off the cold-end face of a refractory brick.

Workers in the steel industry have established that magnesite-carbon brick, when used in electric arc furnace hot spots, slag lines, and side walls, performs better and is cheaper than previously-used fused cast material. Specifically, magnesite-carbon brick, while giving the same number or more heats as fused cast material, requires significantly less gunning maintenance.

A vexing problem, however, is that the cold-end face of magnesite carbon brick oxidizes when exposed to oxygen at service temperatures over about 1000° F. At even higher temperatures, the oxidized brick, no longer possessing the original carbon-pitch bonding system, crumbles easily, causing deterioration of the brick lining from the cold end, i.e. hidden end. More brick is required, increasing the cost per ton of steel.

Inner lining deterioration, hidden from human view, is, of course, extremely dangerous to steel workers. Further, because such inner, hidden deterioration renders it impossible to determine accurately how much furnace lining is remaining, furnace operators lose the ability to determine visually how long a particular lining will last.

As an engineering matter, eliminating air infiltration into the area between the cold-end faces of the bricks and the shell of the electric arc furnace is difficult. In service, furnace shells frequently warp, preventing tight abutment of the brick lining. Brick separation from the top of a furnace shell, rendering top bricks extremely vulnerable to oxidation, is also common. Further, shells often have numerous holes for a variety of reasons.

Convinced that air infiltration is inevitable, workers in the art have attempted to solve the cold end-face oxidation problem by chemically or mechanically sealing off the cold end face of refractory bodies, such as magnesite carbon brick. Various forms, however, of chemical coatings, sealers and powders have not satisfactorily increased the service life of magnesite carbon brick.

In an attempt to reduce contact between air and the cold end face of refractory bodies mechanically, workers have used a metal plate on the cold end face of a brick while additionally wrapping a metal sheathing around two or more adjoining side faces. Gaps between the plate and the sheathing at the edges of the cold end face, however, admit some oxidizing air, regardless of whether the plating is attached simultaneously with, or after, molding of the brick. Accordingly, this method of sealing off the cold end face is still not entirely satisfactory.

The use of either aluminum or steel foil to wrap the end of a brick prior to plating has been suggested as a viable solution. Predicted cold end face service temperatures, however, exceed the melting point of aluminum, while steel foil is disadvantageous because it tends to cut workers. Artisans have accordingly continued a vigorous search for a brick less prone to oxidize at the cold end face in order to reduce the cost per ton of steel.

SUMMARY OF THE INVENTION

The present invention overcomes the problems and disadvantages of the prior art by providing greater effectiveness in sealing off the cold end face of a refractory body particularly one containing an oxidizable additive. The invention is particularly directed to the elimination of the air gaps at the edges of the cold end face of a refractory body. More effectively retarding oxidation, the invention reduces the amount of refractory brick required per ton of steel produced; correspondingly, the cost per ton of steel is reduced.

Broadly, the invention is directed to a refractory structure comprising a refractory body having a rectangular cross section and having a hot end face and a cold end face, each parallel to the rectangular cross section, and two pairs of opposite side faces; and means for sheathing the cold end face and at least two adjoining side faces, the sheathing means including an angular metal plate contacting two adjoining ones of the side faces, and at least one planar portion integral with and normal to the angular plate, the sheathing means covering at least one intersection between a contacted side face and the cold end face.

The invention is further directed to a method for sealing off the cold end face of a refractory body having a rectangular cross section and having a hot end face and a cold end face, each parallel to the rectangular cross section, and first and second pairs of opposite side faces, comprising the steps of: sheathing the cold end face and at least two adjoining side faces with metal plates, the sheathing step including the steps of extending a planar portion from a plate sheathing one of the adjoining side faces and covering the intersection of the one side face and the cold end face with the planar portion.

In a preferred embodiment, two angular plates are utilized, the plates having planar portions in the form of tabs encasing the entire perimeter of the cold end face. A separate metal plate may be used on the cold end face which the tabs overlie, or the planar portions may be in the form of right triangles or rectangles for covering the entire cold end face.

It is to be understood that the foregoing general description and the following detailed description are only illustrative and exemplary and the modifications, neither departing from the spirit nor the scope of the present invention, will be obvious to those skilled in the art. The accompanying drawings, which are incorporated in and constitute a part of this specification, illustrate embodiments of the invention and, together with the description, serve to explain the principles of the invention.

BRIEF DESCRIPTION OF THE DRAWINGS

FIG. 1 is a perspective, exploded view of a 3-sided plating embodiment of the invention.

FIG. 2 is a plan view of the sheet for forming the angular metal plates of FIG. 1 and FIG. 3.

FIG. 3 is a perspective, exploded view of a first 5-sided plating embodiment of the invention.

FIG. 4 is a cold end face view of the embodiment of FIG. 3.

FIG. 5 is a perspective, exploded view of a second 5-sided plating embodiment of the invention.

FIG. 6 is a plan view of a sheet for forming the angular metal plate of FIG. 5.

FIG. 7 is a perspective, exploded view of a third 5-sided plating embodiment of the invention.

FIG. 8 is a plan view of a sheet for forming the angular metal plate of the embodiment of FIG. 7.

FIG. 9 is a perspective, exploded view of an alternative embodiment of FIG. 3.

DESCRIPTION OF THE PREFERRED EMBODIMENTS

Reference will now be made in detail to the present preferred embodiments of the invention, examples of which are illustrated in the accompanying drawings.

Refractory structures, such as those used in lining furnaces, customarily are in the form of bricks having a rectangular cross section and having a hot end face and a cold end face, each parallel to the rectangular cross section, and two pairs of opposite side faces.

In accordance with the invention, means are provided for sheathing the cold end face and at least two adjoining side faces, the sheathing means including an angular metal plate contacting two adjoining ones of the side faces and at least one planar portion integral with and normal to the angular plate, the sheathing means covering at least one intersection between a contacted side face and the cold end face. As embodied herein and shown in FIG. 1, the sheathing means include an angular metal plate 70 contacting two adjoining ones 62 and 64 of the side faces of the refractory body 66 and at least one planar portion 72 integral with and normal to the angular plate 70, the sheathing means covering at least one intersection 74 between a contacted side face 62 and 64 and the cold end face 60.

FIG. 1 represents a 3-sided plating embodiment of the invention for sealing off the cold end face 60 of the refractory body 66. In this embodiment of the invention, the sheathing means includes the angular metal plate 70 and a metal end plate 76 having approximately the same dimensions as the cold end face 60.

Specifically, the metal end plate 76 is placed in contact with the cold end face 60. The angular metal plate 70, shown as a sheet in FIG. 2, includes two integral walls 78 and 80, angled substantially normal to each other and positioned to contact adjoining ones of the faces 62 and 64 of the refractory body 66. The angular metal plate 70 also has the planar portions, preferably elongated tabs 72 at one end edge 82 of each of the walls 78 and 80. The tabs 72 project at about a 90° angle with respect to the walls 78 and 80 to which they are respectively attached.

Preferably, the tabs 72 are bonded to the metal end plate 76. Such bonding may be accomplished by welding, riveting, or combinations or equivalents thereof. It will be apparent from FIG. 1 that the tabs 72 and the metal end plate 76 combine to cover two intersections 74 between the side faces 62 and 64 and the cold end face 60.

The tabs 72 thus form a shoulder around a portion of the perimeter of the cold end face 60 of the refractory body 66 and overlie the metal end plate 76. The tabs 72 at least assist in retaining the metal end plate 76 against the cold end face 60. The angular metal plate 70 may be further secured to the refractory body 66 by means well known in the art, including welding, co-molding, riveting,gluing, mortaring and combinations or equivalents thereof.

As shown in FIGS. 1 and 2, the angular metal plate 70 is preferably L-shaped. Preferably also, as shown in FIG. 1, the walls 78 and 80 of the angular plate 70 are of approximately the same dimensions as adjoining ones of the faces 62 and 64 of the refractory body 66.

Preferably, the angular metal plate 70 is made of steel with a thickness ranging between 0.45 and 1.2 mm.

As is well-known in the art, the angular metal plate 70 functions as a thermal conductor. However, because the primary purpose of the metal end plate 76 is to seal off the cold end face 60 of the refractory body 66, rather than to serve as a thermal conductor, the metal end plate 76 may be made from a lighter gauge metal than the angular metal plate 70. The thickness of the metal end plate 76 preferably ranges between 0.25 and 0.37 mm.

Further, if there is a service requirement for increased thermal conductivity, at least one overlapping angular metal plate 70 may be used. In order to achieve such over-lapping, another angular metal plate 70 is easily positioned, by means well-known in the art, to contact overlappingly the walls 78 and 80 of the underlying angular metal plate 70. The tabs 72 of the overlapping angular metal plate 70, projecting at about a 90° angle with respect to the walls 78 and 80 to which they are respectively attached, overlie the tabs 72 of the angular metal plate 70 secured to the refractory body 66.

The presently preferred embodiment of the invention includes various 5-sided plating arrangements. FIG. 3 represents a perspective, exploded view of such a 5-sided embodiment of the invention and FIG. 4 represents a cold end face view of the embodiment of FIG. 3. In this embodiment, the sheathing means include the metal end plate 76 and two angular metal plates 70.

The metal end plate 76 is placed in contact with the cold end face 60. As seen in FIG. 3, two angular metal plates 70, each formed from the sheet shown in FIG. 2, in combination having the first and second pairs of opposite side walls 78 and 80 and having the tabs 72 at the one end edge 82 of each of the walls 78 and 80, are positioned in contact with the first and second pairs of the opposite side faces 62 and 64 of the refractory body 66.

In order to encase the first and second pairs of opposite side faces 62 and 64 of the refractory body 66, the two angular plates 70 are bonded to the said side faces of the refractory body by an acceptable means known in the art such as gluing, welding, riveting, comolding, or any combination or equivalent thereof.

The tabs 72 of the angular metal plates 70, projecting at about a 90° angle with respect to the walls 78 and 80 to which they are respectively attached, form a shoulder around the perimeter of the cold end face 60 of the refractory body 66 and encase a perimeter portion of the cold end face 60 of the refractory body 66. The tabs 72 overlie the metal end plate 76, which is in contact with the cold end face 60.

Preferably, the tabs 72 are bonded to the metal end plate 76. Such bonding may be accomplished by welding, riveting, or any combination or equivalents thereof. If desired, the end plate 76, or other elements of the sheathing may be secured to the refractory body by means known in the art. FIG. 4 graphically demonstrates the sealing off both the cold end face 60 and all four intersections 74 between the opposite pairs of side faces 62 and 64 and the cold end face 60.

A second 5-sided plating embodiment of the invention is shown in FIG. 5. In this embodiment of the invention, the sheathing means include an angular metal plate 70, as described above, and a second angular metal plate 86, formed from the sheet shown in FIG. 6. As seen in FIG. 5, the two angular metal plates 70 and 86, in combination having the first and second pairs of opposite side walls 78 and 80 are positioned in contact with the first and second pairs of the opposite side faces 62 and 64 of the refractory body 66.

Preferably, the adjoining side edges 84 of the angular metal plate 70 and the second angular metal plate 86 are bonded together.

The second angular metal plate 86 has the tab 72 at the end edge 82 of the wall 80 and a rectangular tab 88 at the end edge 82 of the wall 78, the rectangular tab 88 being of approximately the same dimensions as the cold end face 60 of the refractory body 66. Both the tabs 72 and 88 project at approximately a 90° angle with respect to the walls 80 and 78, with the tab 72 of the second angular metal plate 86 overlying the rectangular tab 88. The tabs 72 of the angular metal plate 70 also project at about a 90° angle with respect to the walls 78 and 80 to which they are respectively attached to encase a portion of the perimeter of the cold end face 60 and to overlie the rectangular tab 88. Thus, the tabs 88 and 72 completely encase the cold end face 60 of the refractory body 66. Preferably the tabs 72 are bonded to the rectangular tab 88.

Preferably, the second angular metal plates 86 is made of steel of a thickness ranging between 0.45 and 1.2 mm.

A third 5-sided plating embodiment of the invention is shown in exploded perspective in FIG. 7. In this embodiment, of the invention, the sheathing means include an angular metal plate 70 and a third angular metal plate 90, formed from the sheet shown in FIG. 8. The third angular metal plate 90 and the angular metal plate 70 formed from the sheet shown in FIG. 2, which in combination have first and second pairs of opposite side walls 78 and 80, are positioned in contact with the first and second pairs of the opposite side faces 62 and 64 of the refractory body 66.

In order to encase the first and second pairs of opposite side faces 62 and 64 of refractory body 60, the angular metal plates 70 and 90 are bonded to the said side faces of the refractory body.

The third angular plate 90 has triangle tabs 92 positioned at the end edges 82 of the walls 78 and 80.

Preferably, the triangle tabs 92, form right triangles, as shown in FIG. 8. The hypotenuses of the triangle tabs 92 meet at the intersection 94 of the walls 78 and 80 of the angular metal plate 90. The triangle tabs 90 projects at about a 90° angle with respect to the walls 78 and 80 to which they are respectively attached in order to be positioned in contact with the cold end face 60 of the refractory body 66. The tabs 72 of the angular metal plate 70 also project at about a 90° angle with respect to the walls 78 and 80 to which they are respectively attached to encase a portion of the perimeter of the cold end face 60 and to overlie the triangle tabs 92. Thus, the tabs 92 and 72 completely encase the cold end face 60 of the refractory body 66. Preferably, the tabs 72 are bonded to the triangle tabs 92.

Preferably, the third angular metal plate 90 is also made of steel of a thickness ranging between 0.45 and 1.2 mm.

With respect to the 5-sided plating embodiments of the invention, illustrated in FIGS. 3, 5 and 7 of the drawings, certain applications may well require increased thermal conductivity, necessitating the encasement of the refractory body 66 by additional angular metal plates. For example, with respect to the embodiment shown in FIG. 3, this can be accomplished by overlying the walls of the angular metal plates 70 with at least one pair of external encasing metal plates 70, as shown in FIG. 9.

In combination, each pair of the external encasing metal plates shown in FIG. 9 has four integral walls 78 and 80, which overlie the four integral walls 78 and 80 of the angular metal plates 70. The external encasing plates 70 also have the tabs 72 at the one end edge 82 of each of their walls 78 and 80, the tabs 72 projecting at about a 90° angle with respect to the walls 78 and 80 to which they are respectively attached to overlie the tabs 72 of the angular metal plate 70.

In addition to disclosing both a refractory structure with better oxidation resistance at the cold end, and a method for sealing off the cold end face of a refractory body, thus reducingthe cost per ton for producing steel, the present invention also offers important manufacturing advantages. The 5-sided plating arrangement, for example, encasing by tabs the perimeter portion of the metal end plate, does not require use of any other physical or chemical means, such as welding, gluing, or riveting, to secure the metal end plate to the cold end face of the refractory body. This specifically avoids the problems of securing the metal end plate to the refractory body by such means as molding insets into the cold end face of the refractory body in order to accept tabs attached to the metal end plate. Additionally, after the plates are blanked and bent, they can be used either in a 3- or 5-sided plating arrangement, permitting great flexibility in the total inventory of plates necessary to produce both arrangements.

Because the primary purpose of the metal end plate is to seal off the cold end of the brick from oxidation, rather than to act as a thermal conductor, the metal end plate can be constructed of a lighter gauge metal than the tabbed metal plate, thus reducing cost. Another advantage is that the planar projections or tabs on the two tabbed metal plates used in the 5-sided arrangement expedite the positioning of the plates onto the refractory body surface.

The fact that the metal end plates can be cut to fit any particular size series also permits great flexibility in the inventory of metal end plates.

EXAMPLE

A laboratory test was designed to evaluate the relative effectiveness of various mechanical and chemical concepts designed to prevent oxidation of the cold end of a refractory body. Various specimens of GRX-356, a commercially available magnesite-carbon brick produced by General Refractories Co. were cut to 5 inches in length and placed as headers into a panel. To simulate electric arc furnace service, the panel was heated to 3000° F. for as long as 72 hours and the cold ends of the refractory specimens were exposed to ambient air conditions.

Such coatings as pitch, sodium silicate, GLASS H, produced commercially by FMC Inorganic Chemical Div., and having a chemical composition of sodium polyphosphate, and boric acid have been proposed to seal cold ends of brick against oxygen infiltration. When such coatings were individually applied to cold ends of GRX-656 specimens, oxidation resistance was found to be no better than for untreated GRX-356 specimens.

The use of oxygen "getters" having a preferential affinity for oxygen, has also been proposed for reducing cold end face oxidation. Accordingly, various specimens were coated with combinations of powdered steel and powdered glass as set forth in Table 1.

TABLE 1

| Brick | Treatment | Coating Thickness |
|---|---|---|
| | Treatment Combinations of GRX-356 Coated With Powdered Steel/Glass | |
| GRX-356 | 80 mesh steel | 0.060" |
| GRX-356 | 80 mesh steel | 0.060" |
| GRX-356 | 80 mesh steel +25% powdered glass | 0.060" |
| GRX-356 | 80 mesh steel +25% powdered glass | 0.060" |
| GRX-356 | Powdered glass | 0.022" |
| GRX-356 | Powdered glass | 0.022" |

All these treatments, however, proved ineffective for preventing oxidation.

Bricks plated on three sides, including the cold end face, were tried. Although plating would theoretically be predicted as highly efficient in preventing oxidation, gaps in the plating, necessitated by forming practicalities, allowed air to come into contact with the brick, preventing maximum effectiveness against cold end oxidation. Similarly, co-molding would appear to be an effective solution to the problem except for the fact that gaps apparently are also inevitable in this design.

Conventional five-sided post-plated bricks were tested but gaps permitted some oxidation at the cold end face. It was found that steel foil is effective for prevention of cold end face oxidation, but the use of steel foil is deemed impractical owing to the dangerous risk that workers will be cut.

Utilization of the teachings of the present invention with respect to a brick prevented oxidation of the cold end face more effectively than either standard post-plating or co-molding. Further, unlike the use of steel foil, the external plating arrangement of the present invention does not endanger the safety of workers.

What is claimed is:

1. A refractory structure comprising:

a refractory body having a rectangular cross section and having a hot end face and a cold end face, each parallel to the rectangular cross section, and two pairs of opposite side faces:

means for sheathing said cold end face and said two pairs of opposite side faces, said sheathing means including two angular metal plates in combination having first and second pairs of opposite side walls, said walls contacting said first and second pairs of opposite side faces; said angular plates having tabs at one end edge of each of their walls to form a shoulder around the perimeter of said cold end of said refractory body, said tabs projecting at about a 90° angle with respect to the wall to which they are respectively attached to encase a perimeter portion of said cold end face of said refractory body, and a metal end plate having approximately the same dimensions as said cold end face of said refractory body, said tabs overlying said end plate and covering all four intersections of said pairs of opposite side faces and said cold end face.

2. The refractory structure of claim 1 wherein said end plate is secured in contact with said cold end face by said tabs.

3. The refractory structure of claim 1 further including additional means for securing said end plate to said cold end.

4. The refractory structure of claim 1 wherein said tabs are bonded to said end plate.

5. The refractory structure of claim 1 wherein said angular plates and said end plate are steel.

6. The refractory structure of claim 1 wherein said refractory body further includes an oxidizable additive.

7. A refractory structure comprising:

a refractory body having a rectangular cross section and having a hot end face and a cold end face, each parallel to the rectangular cross section, and first and second pairs of opposite side faces; and two metal angular plates in combination having first and second pairs of opposite side walls, said walls contacting, respectively, said first and second pairs of opposite side faces, one of said angular plates having tabs at one end edge of each of its walls to form a shoulder around a portion of the perimeter of said cold end face of said refractory body, said second angular plate also having tabs at one end edge of each of said walls, one of said tabs of said second plate having approximately the same rectangular dimensions as said cold end face of said refractory body, all said tabs projecting at about a 90° angle with respect to the walls to which they are respectively attached to encase said cold end face of said refractory body, said rectangular tab of said second angular plate being in contact with said cold end face and the other ones of said tabs overlying said rectangular tab, said tabs covering all four intersections of said pairs of opposite side faces and said cold end face.

8. The refractory structure of claim 7 wherein said rectangular tab is retained in contact with said cold end face by said other tabs.

9. The refractory structure of claim 8 further including additional means for securing said end plate to said cold end.

10. The refractory structure of claim 7 wherein said rectangular tab is bonded to the other tabs.

11. The refractory structure of claim 7 wherein said angular plates and said end plate are steel.

12. The refractory structure of claim 7 wherein said refractory body further includes an oxidizable additive.

13.

A refractory structure comprising:

a refractory body having a rectangular cross section and having a hot end face and a cold end face, each parallel to the rectangular cross section, and first and second pairs of opposite side faces; and two metal angular plates in combination having first and second pairs of opposite side walls, said walls contacting, respectively, said first and second pairs of opposite side faces; one of said angular plates having tabs at one end edge of each of its walls to form a shoulder around a portion of the perimeter of said cold end face of said refractory body, said tabs projecting at about a 90° angle with respect to the walls to which they are respectively attached to encase a portion of the perimeter of said cold end face of said refractory body, the second said angular plate having tabs, each forming triangles, at one end edge of each of its walls, said tabs projecting at about a 90° angle with respect to the wall to which they are respectively attached to contact said cold end face, said triangle tabs overlying said cold end face of said plate, said tabs covering all four intersections of said pairs of opposite side faces and said cold end face.

14. The refractory structure of claim 13 wherein said triangle tabs are secured in contact against said cold end face by said tabs of said one of said angular plates.

15. The refractory structure of claim 14 further including additional means for securing said triangle tabs in contact with said cold end face.

16. The refractory structure of claim 14 wherein said triangle tabs are bonded to said tabs of the first angular plate.

17. The refractory structure of claim 13 wherein said angular plates and said end plate are steel.

18. The refractory structure of claim 13 wherein said refractory body further includes an oxidizable additive.

19. A refractory structure comprising:

a refractory body having a rectangular cross section and having a hot end face and a cold end face, each parallel to the rectangular cross section, and first and second pairs of opposite side faces; and two metal angular plates in combination having first and second pairs of opposite side walls, said walls contacting said first and second pairs of opposite side faces; one of said angular plates having tabs at one end edge of each of its walls to form a shoulder around a portion of the perimeter of said cold end face of said refractory body, said tabs projecting at about a 90° angle with respect to the walls to which they are respectively attached to encase a portion of the perimeter of said cold end face of said refractory body, the second said angular plate having tabs, each forming right triangles, the hypotenuses of said right triangle tabs meeting at the intersection of said walls of said second angular plate, said tabs projecting at about a 90° angle with respect to the wall to which they are respectively attached to contact said cold end face, said right triangle tabs overlying said cold end face of said plate, said tabs covering all four intersections of said pairs of opposite side faces and said cold end face.

20. The refractory structure of claim 1, 7 or 13 further including at least one pair of external encasing metal plates, each pair of said encasing plates in combination having first and second pairs of opposite side walls, said latter walls overlying said first and second pairs of opposite side walls of the two angular plates; said external encasing plates having tabs at one end edge of each of its walls, said tabs projecting at about a 90° angle with respect to the walls to which they are respectively attached to overlie said tabs of said angular plates.

21. A method for sealing off the cold end face of a refractory body having a rectangular cross section and having a hot end face and a cold end face, each parallel to the rectangular cross section, and first and second pairs of opposite side faces comprising the steps of:

sheathing the cold end face and said first and second pairs of opposite side faces with metal angular plates, said sheathing step including the steps of covering the cold end face with a metal end plate having the same dimensions as said cold end face, extending tabs from said metal angular plates sheathing said pairs of opposite side faces, overlying said metal end plate with said tabs and covering all four intersections of said pairs of opposite side faces and said cold end face with said tabs.

* * * * *

UNITED STATES PATENT AND TRADEMARK OFFICE

CERTIFICATE OF CORRECTION

PATENT NO. : 4,261,154

DATED : April 14, 1981

INVENTOR(S) : Jeffrey A. Mazur

It is certified that error appears in the above—identified patent and that said Letters Patent is hereby corrected as shown below:

Claim 16, line 1, change "14" to --13--.

Signed and Sealed this

*Thirtieth* Day of *June 1981*

[SEAL]

*Attest:*

RENE D. TEGTMEYER

*Attesting Officer*

*Acting Commissioner of Patents and Trademarks*